US011549340B2

(12) United States Patent
Chitwood et al.

(10) Patent No.: US 11,549,340 B2
(45) Date of Patent: Jan. 10, 2023

(54) WELL ANNULUS FLUID EXPANSION STORAGE DEVICE

(71) Applicant: Safe Marine Transfer, LLC, Houston, TX (US)

(72) Inventors: James E. Chitwood, Spring, TX (US); Art J. Schroeder, Jr., Houston, TX (US); Tom A. Gay, Houston, TX (US)

(73) Assignee: Safe Marine Transfer, LLC, Houston, TX (US)

( * ) Notice: Subject to any disclaimer, the term of this patent is extended or adjusted under 35 U.S.C. 154(b) by 475 days.

(21) Appl. No.: 16/633,216

(22) PCT Filed: Oct. 30, 2018

(86) PCT No.: PCT/US2018/058234

§ 371 (c)(1),
(2) Date: Jan. 23, 2020

(87) PCT Pub. No.: WO2019/139664

PCT Pub. Date: Jul. 18, 2019

(65) Prior Publication Data

US 2020/0190948 A1 Jun. 18, 2020

Related U.S. Application Data

(60) Provisional application No. 62/615,828, filed on Jan. 10, 2018.

(51) Int. Cl.
*E21B 43/12* (2006.01)
*E21B 41/00* (2006.01)
(Continued)

(52) U.S. Cl.
CPC ..... *E21B 41/0007* (2013.01); *E21B 33/035* (2013.01); *E21B 36/04* (2013.01); *E21B 37/06* (2013.01)

(58) Field of Classification Search
CPC .... E21B 7/208; E21B 17/042; E21B 17/0423; E21B 17/08; E21B 23/04; E21B 29/10;
(Continued)

(56) References Cited

U.S. PATENT DOCUMENTS 9,540,169 B1 * 1/2017 Krohn ..... B65D 88/78
2003/0024708 A1 * 2/2003 Ring ..... E21B 33/03 166/207
(Continued)

FOREIGN PATENT DOCUMENTS

CA 2215652 A1 3/1999
GB 2454297 A 5/2009
(Continued)

OTHER PUBLICATIONS

International Search Report issued in corresponding International Application No. PCT/US2018/058234 dated Feb. 19, 2019 (4 pages).
(Continued)

*Primary Examiner* — Edwin J Toledo-Duran
(74) *Attorney, Agent, or Firm* — Osha Bergman Watanabe & Burton LLP

(57) ABSTRACT

A pressure rated well annulus fluid expansion storage device that is capable of managing pressure variation within a well annulus by removing or adding fluid to the well annulus. The well annulus fluid expansion storage device includes an annulus fluid expansion unit containing a well annulus fluid and a working fluid, the annulus fluid expansion unit further includes a moveable partition maintaining the working fluid and the well annulus fluid in separate chambers, a working fluid storage tank that stores the working fluid, an adjustable pressure control valve that maintains a pressure of the working fluid, a working fluid pump that feeds and pressurizes working fluid from the working fluid storage tank into the annulus fluid expansion unit, a check valve that allows flow of working fluid from the working fluid storage tank to the annulus fluid expansion unit, and a flow line for receiving and discharging well annulus fluid.

21 Claims, 1 Drawing Sheet

(51) Int. Cl.
*E21B 33/035* (2006.01)
*E21B 36/04* (2006.01)
*E21B 37/06* (2006.01)

(58) Field of Classification Search
CPC ..... E21B 33/03; E21B 33/04; E21B 33/047; E21B 33/10; E21B 33/14; E21B 43/084; E21B 43/103; E21B 43/105; E21B 43/106; E21B 43/14; E21B 43/305; E21B 41/0007; E21B 33/035; E21B 36/04; E21B 37/06; E21B 43/12; F16L 15/003
See application file for complete search history.

(56) References Cited

U.S. PATENT DOCUMENTS

2003/0094279 A1* 5/2003 Ring ..... E21B 23/04 166/250.01
2006/0144619 A1* 7/2006 Storm, Jr. ..... E21B 47/017 166/57
2007/0114063 A1* 5/2007 Wilfredo ..... E21B 21/08 175/57
2009/0183879 A1* 7/2009 Cox ..... E21B 43/121 166/302
2012/0000279 A1* 1/2012 Daniel ..... E21B 49/10 73/152.28
2014/0130498 A1* 5/2014 Randolph ..... E21B 43/40 166/267
2016/0325927 A1* 11/2016 Chitwood ..... B65D 90/046

FOREIGN PATENT DOCUMENTS

WO 2008/147217 A2 12/2008
WO 2012/091706 A1 7/2012

OTHER PUBLICATIONS

Written Opinion issued in corresponding International Application No. PCT/US2018/058234 dated Feb. 19, 2019 (6 pages).
Office Action issued in corresponding BR Application No. BR1120200025658 dated May 31, 2022 (4 pages).

* cited by examiner

WELL ANNULUS FLUID EXPANSION STORAGE DEVICE

BACKGROUND

Subsea production wells are conventionally operated through metal tubes bundled together with electric power and control lines that are collectively called an umbilical. Umbilicals can cost upwards of a million dollars or more per mile. Installation can also be expensive and must be performed with great care to avoid crimping or damaging the metal tubes. The tubes can also have a tendency to foul or plug over time.

The metal tubes supply production chemicals to manage production fluid issues like asphaltene, wax, paraffin, scale deposition, hydrate formation, corrosion, etc. Typically, one metal tube is required for each chemical. The metal tubes also supply hydraulic control fluids to hydraulically operate a device such as a valve or a choke. Additionally, the metal tubes provide a well annulus venting function so the pressure build-up in the annulus may be managed during thermal cycling (start-up and shut-down) of the well.

The umbilical connects the subsea well back to a surface host facility. The host facility, among other functions, serves as the storage point for the production chemicals and hydraulic control fluids. The host also has pumps and other equipment to provide the necessary pressure to pump the fluids through the umbilical to the point of need at the subsea well. As the subsea tieback distances have been extended and the pressures required at the point of injection have continued to increase, umbilical costs have correspondingly spiraled upward.

The supply of chemicals and hydraulic fluids to the subsea well may be provided by a subsea liquid storage tank and pump based injection system, such as that described in U.S. Pat. No. 9,656,801, incorporated herein by reference. Such a system is capable of providing both the production chemical supply and the hydraulic control fluids by withdrawing the necessary chemical and/or hydraulic control fluids from local subsea pressure compensated storage tanks, boosting its pressure and injecting the liquid at appropriate points of use at or near the wellhead. Such systems have not been designed to handle well annulus vent functions, however.

SUMMARY

In one aspect, embodiments disclosed herein relate to a pressure rated well annulus fluid expansion storage device that is capable of managing pressure variation within a well annulus by removing or adding fluid to the well annulus. The well annulus fluid expansion storage device includes an annulus fluid expansion unit containing a well annulus fluid and a working fluid, wherein the annulus fluid expansion unit further includes a moveable partition maintaining the working fluid and the well annulus fluid in separate chambers of the annulus fluid expansion unit, a working fluid storage tank that stores the working fluid, an adjustable pressure control valve that maintains a pressure of the working fluid, a working fluid pump that feeds and pressurizes working fluid from the working fluid storage tank into the annulus fluid expansion unit, a check valve that allows flow of working fluid from the working fluid storage tank to the annulus fluid expansion unit, and a flow line for receiving and discharging well annulus fluid to and from, respectively, the annulus fluid expansion unit.

In another aspect, embodiments disclosed herein relate to a process for managing well annulus pressure using a pressure rated well annulus fluid expansion storage device. The process including alternately removing a well annulus fluid from an expansion storage device and adding the well annulus fluid to the expansion storage device, and alternately adding a working fluid to the expansion storage device and removing the working fluid from the expansion storage device. When the well annulus fluid is being removed the working fluid is being adding, and the well annulus fluid is being added the working fluid is being removed. The process further includes maintaining the working fluid and the well annulus fluid in separate chambers of the annulus fluid expansion unit using a moveable partition. The working fluid is stored in a working fluid storage tank. An adjustable pressure control valve maintains pressure of the working fluid, and a working fluid pump pressurizes and feeds the working fluid into the annulus fluid expansion unit. The process further includes receiving and discharging well annulus fluid to and from, respectively, the annulus fluid expansion unit.

In another aspect, embodiments disclosed herein relate to a pressure rated well annulus fluid expansion storage device that is capable of managing a pressure variation of a well annulus by removing or adding fluid to the well annulus. The well annulus fluid expansion storage device includes an annulus fluid expansion unit having a first chamber fluidly connected to a subsea Christmas tree, a second chamber fluidly connected to a working fluid storage device, and a piston, bladder, or spring seal separating the first and second chambers, which allows a volume of the first and second chambers to respectively fluctuate. The well annulus fluid expansion storage device further includes an adjustable pressure control valve that maintains a set point pressure within the second chamber, a working fluid pump that feeds a pressurized working fluid from the working fluid storage device to the annulus fluid expansion unit, and a check valve that allows flow of working fluid from the working fluid storage device to the annulus fluid expansion unit.

In yet another aspect, embodiments disclosed herein relate to a process for removing or adding fluid to a well annulus, using a well annulus fluid expansion storage device having an annulus fluid expansion unit. The process includes fluidly connecting the first chamber of the annulus fluid expansion unit to the subsea Christmas tree, fluidly connecting the second chamber of the annulus fluid expansion unit to the working fluid storage device. The process further includes maintaining a working fluid set point pressure within the second chamber with one or more of the adjustable pressure control valve, the check valve, or the working fluid pump, and varying a volume of the first and second chambers as the well annulus fluid expands and contracts.

Other aspects and advantages will be apparent from the following description and the appended claims.

DETAILED DESCRIPTION

One or more embodiments herein relate to a system and process for maintaining well annulus pressure without the need for expensive umbilical vent lines.

The well annulus vent function is complex, and all aspects must be reliably managed. Temperature changes in the annulus fluids due to change in well conditions, such as shut-in and startup, result in pressure changes due to thermal expansion or contraction of the annulus fluids in a fixed annulus volume. As a result, annulus fluids must expand into and out of the well annulus to manage annulus pressure and ensure the annulus is not over-pressured. Additionally, hydrocarbon contamination of the annulus fluid can occur if the production tubing should leak and solids like hydrates can plug the system.

Figure 1:
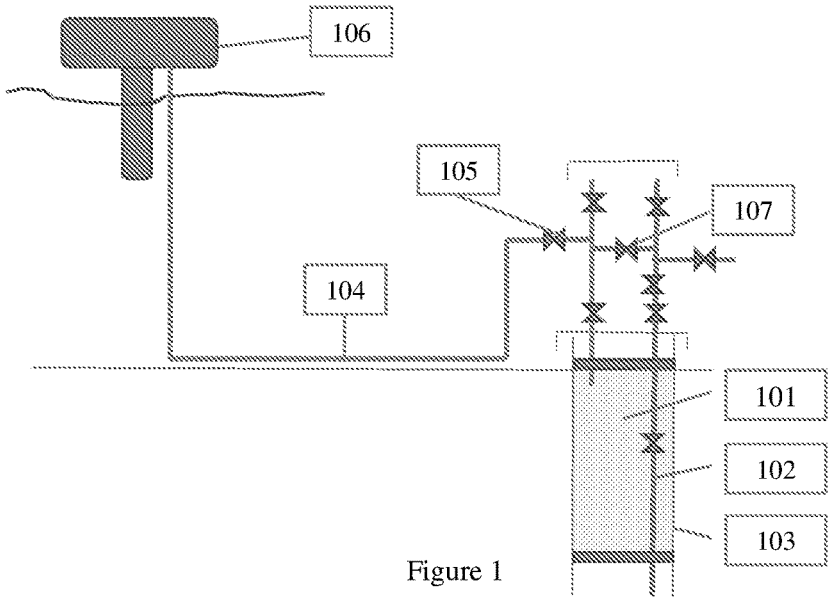
FIG. 1 is an illustration of a subsea wellhead and Christmas tree.

A subsea Christmas tree is schematically shown in FIG. 1. As illustrated, the Christmas tree includes a collection of valves and barriers that manage the safe production of hydrocarbons from the well reservoirs, known as production fluid. The well's primary annulus 101 is a fixed volume outside the production tubing 102 and inside the production casing 103 of the well. This primary annulus is typically filled with a completion fluid that expands when heated by production of hydrocarbons from the reservoir. Since the primary annulus 101 is a closed volume, this completion fluid thermal expansion results in excessive annulus pressure, unless the expansion volume is vented. Conventionally, the annulus vent tube within an umbilical 104 provides a volume for the annulus fluid to expand into and flow out of as temperature fluctuates. This expansion volume may range from a few gallons to several barrels depending upon the specific well annulus volume, the completion fluid coefficient of expansion, and the maximum thermal differential in the wellbore. In some cases, the volume of expansion may be 30 barrels or more. As an example, with a one-half inch annulus vent tube, this volume may substantially fill all of the volume of a vent tube within umbilical 104 from the Christmas tree annulus wing valve 105 back to the host facility 106. Should there be a production tubing 102 leak and production is pressurizing the well annulus, the expansion volume can be isolated using the Christmas tree annulus wing valve 105 and the production leak vented into the production flow line using the Christmas tree cross-over valve 107 and the well production choke. Although the expansion volume may vary in size, the principles of expansion space operation are common.

According to one or more embodiments, herein is disclosed a system and method for managing this annulus fluid expansion without the need for the complex, and costly, umbilical vent line system which is conventionally used.

Figure 2:
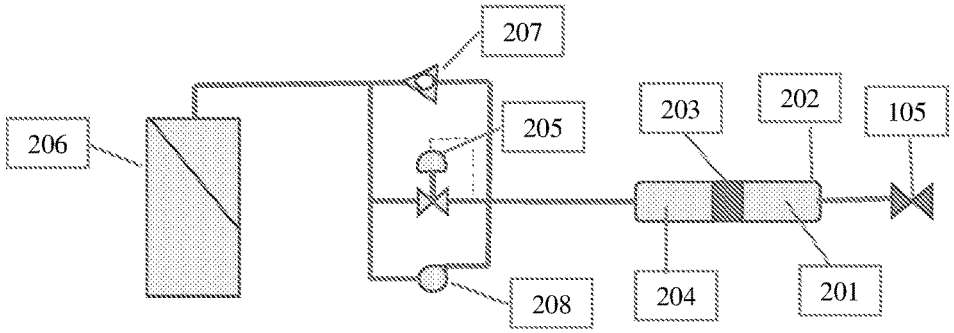
FIG. 2 is an illustration of a well annulus fluid expansion storage device according to embodiments disclosed herein.

FIG. 2 illustrates a well annulus fluid expansion storage device according to one or more embodiments disclosed herein. As illustrated, the well annulus fluid expansion storage device is a modular assembly which may lead to efficient deployment and recovery from subsea with an ROV and a lift line from a workboat on the sea surface.

The well annulus fluid expansion storage device may be attached to the Christmas tree annulus wing valve 105, substituting for the umbilical annulus vent tube, or in addition to the umbilical annulus vent tube. The volume of well annulus fluid expansion 201 is contained within a first chamber of an annulus fluid expansion unit 202, and the volume of working fluid 204 is contained within a second chamber of the annulus fluid expansion unit 202. The first chamber may be fluidly connected to the subsea Christmas tree using Christmas tree annulus wing valve 105, and the second chamber may be fluidly connected to a working fluid storage device 206. The working fluid storage device 206 may also be pressure rated for the desired operating depth. One or more flow lines may be provided for receiving and discharging well annulus fluid to and from, respectively, the annulus fluid expansion unit.

The annulus fluid expansion unit 202 may be a cylindrical shaped pressure vessel with a wall thickness which may maintain rigidity under the high pressure maximum allowable operating pressure (MAOP) of the well annulus. The total volume of the annulus fluid expansion unit 202 may be a few gallons, a few barrels, or several barrels, depending on the expansion volume needs of the particular well annulus. Such a volume may be 3 gallons to 50 barrels, such as 5 gallons to 15 barrels, such as 10 gallons to 2 barrels, and such as 30 gallons to 1.5 barrels.

Within this expansion space a moveable partition may be disposed. Such a moveable partition may be a fluid separation piston ("piston") 203 which may be used to maintain the well annulus fluid 201 and a working fluid 204 in separate chambers of annulus fluid expansion unit. The working fluid 204 will typically be a hydrate inhibitor such as methanol or monoethylene glycol or other fluid to prevent the formation of hydrates. Alternatively, the working fluid may be an evaporating/condensing fluid that evaporates at a seabed temperature of 2° C. to 6° C.

The annulus fluid expansion unit 202 may have a first end on the side containing the working fluid 204 and a second end located on the side containing the well annulus fluid 201. The piston 203 may be used to seal off the annulus fluid expansion unit 202 should the piston 203 reach the first or the second end of the annulus fluid expansion unit 202. This may allow for the piston 203 to act as a shut-off valve in cases where annulus fluid volume exceeds safe operating conditions.

In one or more embodiments, instead of a piston 203, the annulus fluid 201 may be separated from the working fluid 204 by a flexible bladder, as the moveable partition. When using a flexible bladder, the annulus fluid expansion unit 202 may have a first valve located on the side containing the working fluid 204 and a second valve located on the side containing the well annulus fluid 201. The first and second valves may be used to close off the annulus fluid expansion unit 202 when the flexible bladder reaches a maximum or a minimum volume for the well annulus fluid. Such volume may be substantially the volume of the annulus fluid expansion unit 202.

In one or more embodiments, instead of a piston 203, the annulus fluid 201 may be separated from the working fluid 204 by a spring seal, as the moveable partition. The spring seal may also be used to seal off the annulus fluid expansion unit 202 should the spring seal reach the first or the second end of the annulus fluid expansion unit 202. The piston, flexible bladder, or spring seal may allow the volume of the first and second chambers to fluctuate respectively.

The working fluid may be pressure controlled remotely by an adjustable pressure control valve 205 which may maintain a desired pressure range of the working fluid in the annulus fluid expansion device, and in the well annulus as the annulus fluid expand. The adjustable pressure control valve 205 may vent the working fluid into the working fluid storage tank 206 to maintain the desired annulus pressure. When working fluid is being pumped from the working fluid storage tank 206 to the annulus fluid expansion unit 202, the adjustable pressure control valve 205 may be remotely closed.

In one or more embodiments, a check valve 207 may enable the flow of working fluid, up to the expansion volume, from the working fluid storage tank 206 to the annulus fluid expansion unit 202. The check valve may be used to return annulus fluid to the well annulus space during cool down when annulus fluid is contracting. The check valve 207 may provide flow from the working fluid storage tank 206 when the annulus pressure is slightly below hydrostatic pressure. Under normal operations, annulus pressure may be maintained at a differential pressure above hydrostatic pressure. The MAOP rating of annulus fluid expansion unit 202 may compatible with the wellhead shut-in pressure (maximum well pressure). Additionally, the wellhead and Christmas tree may provide primary well control and this high MAOP may provide an extra measure of high pressure management contingency.

A working fluid pump 208 may be used to increase annulus fluid pressure. The working fluid pump 208 may also be used feed working fluid from the working fluid storage tank 206 to annulus fluid expansion unit 202.

The working fluid storage tank 206 may be similar to the fluid storage tanks as described in U.S. Pat. No. 9,079,639 B2, incorporated herein by reference.

Such a fluid storage tank may include an outer container and at least two inner containers. The outer container may be rigid, while the inner containers may be flexible. For example, the inner containers may be bladders made of a flexible, durable materials suitable for storing liquids in a subsea environment, such as polyvinyl chloride ("PVC") coated fabrics, ethylene vinyl acetate ("EVA") coated fabrics, or other polymer composites. The inner containers may include a first inner container containing seawater and a second inner container containing at least one stored liquid. The inner containers may be pressure balanced such that as the stored liquid is added or removed from the second inner container, a corresponding volume of seawater outflows or inflows from the first inner container. Monitoring of the conditions in the space between the dual barriers, such as described below, may provide an indication of required repairs for a failure of a primary barrier (an inner container). Further, integral safety features may be included in the storage tank to prevent damage to the tank system in the event the tank is emptied or overfilled.

The outer container may be of any shape and made of any material. For example, the outer container may be a metallic construction and integrated within a larger structure. Further, the outer container may be a size that is large enough to contain at least two inner containers. For example, an outer container may be large enough to contain two or more flexible inner containers that are capable of storing an amount of liquid sufficient for use for a long duration, such as between resupply operations. Further, two or more rigid outer containers may be connected together to become part of a multi-unit structure. For example, a barge having multiple separate holds may form a multi-unit structure, wherein each hold forms a rigid outer container connected to each other.

Further, the volume of the outer container remains fixed, and the volumes of the at least two inner containers are variable. For example, while the stored liquid may be added or removed from the second inner container through a controlled opening (and increase or decrease the respective volume of the second inner container) and a corresponding volume of seawater may outflow or inflow from the first inner container through a controlled opening (and decrease or increase the respective volume of the first inner container), the size and volume of the rigid outer container remains fixed.

At least one inner container may be filled with a liquid including at least one of chemicals, fuel, hydrocarbons, muds, and slurries. As used herein, a "stored liquid" or a "liquid" may refer to liquids other than seawater or gases. For example, various liquids or gases that may be stored in at least one inner container may include chemicals expected to be used in subsea production, such as methanol, glycol, diesel, oil, antiagglomerate hydrate inhibitors, low dosage hydrate inhibitors, slops, muds, slurries and many other possible liquids or gases. Further, liquids that may be stored in the flexible inner container(s) may include those capable of functioning in deepsea hydrostatic pressure (up to 5,000 psi) and cold deepsea temperature (~34° F.), while also maintaining the flexibility of the inner container.

A storage tank may be shaped to act as a barge or other seaborne vessel with an internal cargo hold containing at least two flexible inner containers. The storage tank may include a bow for towing and/or double-sided walls to minimize consequences if a collision occurs during towing. Double-sided walls of a storage tank may also be used for buoyancy in floating the storage tank during towing and transit, which may subsequently be flooded when the tank is fully submersed. Further, in some embodiments, a storage tank shaped as a seaborne vessel may be subdivided into smaller compartments for containing and segregating multiple flexible inner containers filled with at least one type of chemical or for greater chemical storage volume.

Sensors may be used in the storage tank, for example, to monitor contamination of the barrier fluid, as discussed above, to monitor the volumes of the at least two inner containers, to monitor temperature and/or pressure conditions, or to monitor other conditions of the storage tank.

According to one or more embodiments, a series of sensors (temperature, pressure, piston position indicator. etc.) may also be used to monitor conditions of the well annulus fluid expansion storage device. Further, the well annulus fluid expansion device may be fitted with piping and compartments to house and protect the working fluid pump 208 and meter components that route the working fluid (or other liquid other than seawater) through high pressure hoses or tubes to the annulus fluid expansion unit 202.

Depending upon the working fluid operating pressure, annulus fluid operating pressure, and the application, both the piping and pump may be appropriately sized, or if the working fluid is in a sub-hydrostatic environment, then a throttling valve and metering system may also be used. A control pod may control the pump and monitor any sensors monitoring the operation of the storage tank and the metering system.

The well annulus expansion storage device may also include a series of hydraulic components, electrical components, and control redundancies and back-ups which are not schematically illustrated. For example, multiple annulus fluid expansion units may be manifolded together in parallel to provide a larger expansion volume. In some embodiments multiple annulus fluid expansion units may be placed in parallel to provide redundancy in case of a leak of the annulus fluid. Additionally, multiple working fluid storage tanks may be used to increase the total volume of working fluid, reduce the volume contained in any one tank, or both.

In one or more embodiments, the pressure of the working fluid may be achieved by using a set of external gas storage cylinders or accumulators connected to the annulus fluid expansion unit. These tanks may perform the same function as the working fluid pump.

In order to inhibit hydrate formation, the well annulus fluid expansion storage device may be equipped with an electrical heater. The heater may provide the necessary heating requirements to prevent hydrate formation within the annulus fluid in the annulus fluid expansion unit.

Alternatively, or in addition to the electrical heater, the well annulus fluid expansion storage device may have an insulated layer. Such an insulated layer may use heat from a well production fluid to heat the annulus fluid in the annulus fluid expansion unit and reduce the formation of hydrates.

Additionally, the well annulus fluid expansion storage device may have a flow line connecting the Christmas tree to the annulus fluid expansion unit. A hydrate inhibiting chemical may be injected into the annulus fluid expansion unit by injecting the chemical through the flow line. Any of the electrical heater, insulated layer, and hydrate inhibiting chemical may be used to reduce the formation of hydrates.

According to one or more embodiments disclosed herein is a process for managing well annulus pressure using a pressure rated well annulus fluid expansion storage device located proximate to a subsea wellhead or Christmas tree. Working fluid and well annulus fluid are alternately removed and added to the well annulus fluid expansion device. In such embodiments, when the well annulus fluid is being removed the working fluid is being adding, and when the well annulus fluid is being added the working fluid is being removed.

In one or more embodiments, the annulus fluid may be separated from the working fluid with a piston, flexible bladder, or a spring seal. The working fluid may be stored in a working fluid storage tank and the pressure of the well annulus fluid may be maintained within the well annulus with an adjustable pressure control valve, and pressurized with a working fluid pump.

Similar to that of a conventional umbilical annulus vent tube, should there be a downhole tubing leak and production fluid is pressurizing the well annulus, the expansion volume may be isolated using the Christmas tree annulus wing valve 105 and the production fluid leak vented into the production flow line using the Christmas tree crossover valve 107 (FIG. 1) and the well production choke.

According to embodiments disclosed herein, the well annulus fluid expansion storage device may be shaped to act as a barge or other seaborne vessel with an internal cargo hold containing the storage tanks, pumps, and other equipment. For some situations, the designs described above may be installed in the annulus itself, below the tubing hanger instead of outside the wellhead. The designs installed in the annulus may be multiple units to achieve the desired volume expansion capacity. In embodiments where the well annulus fluid expansion device is installed within the annulus, the device may enclose a volume on the annulus space which is large enough to contain the total expansion volume of the annulus fluid.

While the disclosure includes a limited number of embodiments, those skilled in the art, having benefit of this disclosure, will appreciate that other embodiments may be devised which do not depart from the scope of the present disclosure. Accordingly, the scope should be limited only by the attached claims.

What is claimed:

1. A pressure rated well annulus fluid expansion storage device, comprising:

an annulus fluid expansion unit containing a well annulus fluid and a working fluid, wherein the annulus fluid expansion unit further comprises a moveable partition maintaining the working fluid and the well annulus fluid in separate chambers of the annulus fluid expansion unit;

a working fluid storage tank containing the working fluid;

an adjustable pressure control valve which maintains a pressure of the working fluid;

a working fluid pump which feeds pressurized working fluid from the working fluid storage tank into the annulus fluid expansion unit;

a check valve which allows flow of working fluid from the working fluid storage tank to the annulus fluid expansion unit; and a flow line for receiving and discharging well annulus fluid to and from, respectively, the annulus fluid expansion unit:

wherein the pressure rated well annulus fluid expansion storage device is capable of managing a pressure variation of a well annulus by receiving and discharging the well annulus fluid to and from, respectively, the annulus fluid expansion unit.

2. The pressure rated well annulus fluid expansion storage device of claim 1, wherein the moveable partition further comprises a piston that separates the well annulus fluid from the working fluid.

3. The pressure rated well annulus fluid expansion storage device of claim 2, wherein the annulus fluid expansion unit comprises a first end proximate a working fluid side and a second end proximate a well annulus fluid side, wherein the piston seals off the annulus fluid expansion unit should the piston reach the first or the second end of the annulus fluid expansion unit.

4. The pressure rated well annulus fluid expansion storage device of claim 1, wherein the moveable partition further comprises a flexible bladder that separates the well annulus fluid from the working fluid.

5. The pressure rated well annulus fluid expansion storage device of claim 4, wherein the annulus fluid expansion unit comprises a first valve proximate a working fluid side and a second valve proximate a well annulus fluid side, wherein the first and second valves are configured to close when the flexible bladder reaches a maximum or a minimum volume for the well annulus fluid.

6. The pressure rated well annulus fluid expansion storage device of claim 1, wherein the moveable partition further comprises a spring seal that separates the well annulus fluid from the working fluid.

7. The pressure rated well annulus fluid expansion storage device of claim 6, wherein the annulus fluid expansion unit comprises a first end proximate a working fluid side and a second end proximate a well annulus fluid side, wherein the spring seal seals off the annulus fluid expansion unit should the piston reach the first or the second end of the annulus fluid expansion unit.

8. The pressure rated well annulus fluid expansion storage device of claim 1, further comprising an electrical heater configured to reduce the formation of hydrates.

9. The pressure rated well annulus fluid expansion storage device of claim 1, further comprising an insulated layer configured to use heat from a well production fluid to reduce the formation of hydrates.

10. The pressure rated well annulus fluid expansion storage device of claim 1, further comprising a flow line connecting a subsea wellhead to the annulus fluid expansion unit, wherein a hydrate inhibiting chemical is injected into the annulus fluid expansion unit by routing the chemical injection through the flow line.

11. The pressure rated well annulus fluid expansion storage device of claim 1, wherein the working fluid is one or more of methanol and monoethylene glycol or other fluid to prevent the formation of hydrates.

12. The pressure rated well annulus fluid expansion storage device of claim 1, wherein the working fluid is an evaporating/condensing fluid that evaporates at a seabed temperature of 2° C. to 6° C.

13. The pressure rated well annulus fluid expansion storage device of claim 1, further comprising two or more annulus fluid expansion units operated in parallel to provide an increased expansion volume.

14. A process for managing well annulus pressure using a pressure rated well annulus fluid expansion storage device having an annulus fluid expansion unit, the process comprising:

alternately removing a well annulus fluid from the annulus fluid expansion unit and adding the well annulus fluid to the annulus fluid expansion unit;

alternately adding a working fluid to the annulus fluid expansion unit and removing the working fluid from the annulus fluid expansion unit;

wherein when the well annulus fluid is being removed the working fluid is being added, and when the well annulus fluid is being added the working fluid is being removed;

maintaining the working fluid and the well annulus fluid in separate chambers of the annulus fluid expansion unit using a moveable partition;

storing the working fluid in a working fluid storage tank;

maintaining pressure of the working fluid with an adjustable pressure control valve;

pressurizing the working fluid with a working fluid pump and feeding the pressurized working fluid into the annulus fluid expansion unit; and receiving and discharging well annulus fluid to and from, respectively, the annulus fluid expansion unit.

15. The process of claim 14, further comprising sealing the annulus fluid expansion unit when the moveable partition reaches a first end proximate a working fluid side or a second end proximate a well annulus fluid side.

16. The process of claim 14, further comprising heating the annulus fluid with an electrical heater, reducing the formation of hydrates.

17. The process of claim 14, further comprising heating an insulated layer using heat from a well production fluid, reducing the formation of hydrates.

18. The process of claim 14, further injecting a hydrate inhibiting chemical into the annulus fluid expansion unit from a subsea wellhead via a flow line.

19. The process of claim 14, further comprising operating two or more annulus fluid expansion units operated in parallel to provide an increased expansion volume.

20. A pressure rated well annulus fluid expansion storage device comprising:

an annulus fluid expansion unit comprising:

a first chamber fluidly connected to a subsea Christmas tree;

a second chamber fluidly connected to a working fluid storage device;

a piston, bladder, or spring seal which separates the first and second chambers, and allows a volume of the first and second chambers to respectively fluctuate;

the working fluid storage device, comprising an internal volume containing the working fluid;

an adjustable pressure control valve which maintains a set point pressure within the second chamber;

a working fluid pump which feeds a pressurized working fluid from the working fluid storage device to the annulus fluid expansion unit; and a check valve configured to which allows flow of working fluid from the working fluid storage device to the annulus fluid expansion unit;

wherein the pressure rated well annulus fluid expansion storage device is capable of managing a pressure variation of a well annulus by receiving and discharging the well annulus fluid to and from, respectively, the annulus fluid expansion unit.

21. A process for removing or adding fluid to a well annulus, using the well annulus fluid expansion storage device of claim 20, the process comprising:

fluidly connecting the first chamber of the annulus fluid expansion unit to the subsea Christmas tree;

fluidly connecting the second chamber of the annulus fluid expansion unit to the working fluid storage device;

maintaining a working fluid set point pressure within the second chamber with one or more of the adjustable pressure control valve, the check valve, or the working fluid pump; and varying a volume of the first and second chambers as the well annulus fluid expands and contracts.

* * * * *